United States Patent [19]

Daraux

[11] 3,990,177

[45] Nov. 9, 1976

[54] SNAP-ACTION TOY

[75] Inventor: Philippe Raymond Joseph Jean Daraux, Toulouse, France

[73] Assignee: Werner Weber, Tuebingen, Germany

[22] Filed: Feb. 11, 1975

[21] Appl. No.: 549,014

[30] Foreign Application Priority Data

Feb. 15, 1974 France ..... 74.05130

[52] U.S. Cl. ..... 46/191; 46/129; 272/27 R

[51] Int. Cl.[2] ..... A63H 5/00

[58] Field of Search ..... 46/191, 192, 193, 189, 46/36, 26, 129, 17, 31; 272/8 N, 27 N, 27 R; 84/402

[56] References Cited

UNITED STATES PATENTS

| | | | |
|---|---|---|---|
| 508,391 | 11/1893 | Reiff | 272/27 R |
| 956,632 | 5/1910 | Finch | 46/26 |
| 1,000,395 | 8/1911 | Frost | 46/26 |
| 1,201,710 | 10/1917 | Finch | 46/26 |
| 2,535,868 | 12/1950 | Roberts | 46/129 |
| 3,120,078 | 2/1964 | Bessinger | 46/17 X |
| 3,271,895 | 9/1966 | Sorensen | 46/31 |

*Primary Examiner*—F. Barry Shay

[57] ABSTRACT

A new type of snap-action toy formed from a pair of plate elements is described. A pair of substantially identical plate elements are normally positioned in overlying relation, with corresponding first edges thereof adjacent and parallel. Aligned pairs of transverse grooves or recesses are cut into the plates parallel to their first edges, and a rubber band or other resilient closed ring extends around all the aligned recesses to hold the plates together in the initial overlapped relation. The plates are then subjected to a 360° relative rotation about their respective parallel edges against the restoring force of the elastic band until the plates are again in overlapping relation in the opposite sense, and the plates are held in this position by the player's hand. When the player releases the plates from this position, the restoring force of the bands immediately rotate the plates in the opposite direction to their original orientation, whereby their overlapping surfaces snap together to make a sound that is characteristic of the size and shape of the plates.

4 Claims, 4 Drawing Figures

SNAP-ACTION TOY

FIELD OF THE INVENTION

The invention relates to snap-action toys of the type wherein two cooperating elements are initially held by a player against the restoring force of an elastic band or spring, and then released so that the elements bang together to form a characteristic sound.

SUMMARY OF THE INVENTION

The present invention relates to improvements in the construction of snap-action toys of the above-mentioned type.

In an illustrative embodiment, the toy includes a pair of plate elements, each element having opposed first and second surfaces and corresponding first edges. The first edges of the plates are disposed parallel and adjacent each other, whereby the plates may be relatively rotated through 360° in a first plane of oscillation about their respective adjacent first edges, between a first position or orientation in which the first surfaces of the elements overlap and contact each other, and a second orientation in which the opposed second surfaces of the elements overlap and contact each other.

An elastic band or other resilient means is associated with the plates for normally urging the plates into their first orientation, whereby a progressive resistance is effected by the restoring force of the resilient means to the rotation of the plate elements from the first to the second orientation. The elements are maintained in proper relation to each other during the rotation either by the resilient means acting alone, or by such resilient means in cooperation with a hinge or flexible band that physically connects the first edges of the elements.

In one arrangement of this type, the resilient means is a closed elastic band which extends around and is captured in pairs of aligned transverse recesses disposed in each of the plate elements parallel to their first edges. In this case, when a player rotates the elements against the force of the band from the first to the second orientations, a subsequent release of the tensioned elements is effective to snap the elements back into their first position, and the latter make an impact noise that depends upon the shape and configuration of the contacting surfaces of the elements.

BRIEF DESCRIPTION OF THE DRAWING

The invention is further set forth in the following detailed description taken in conjunction with the appended drawing, in which.

DETAILED DESCRIPTION

Figure 1:
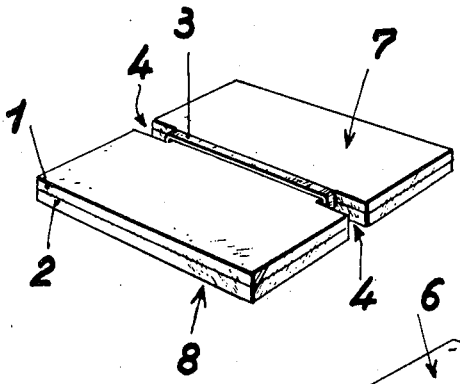
FIG. 1 is a perspective view of a snap-action toy constructed in accordance with the invention and held in a first, normal orientation by means of a transversely disposed elastic band.

Referring to the drawing, the snap-action toy of the invention includes a pair of integral plate elements 1 and 2 which are associated with an elastic band 3 or other resilient means in the manner to be described. The plate 1 includes a pair of opposed surfaces 5 and 7 separated by an edge 11, while the plate 2 exhibits a pair of opposed surfaces 6 and 8 separated by a corresponding edge 12.

Each of the plates 1 and 2 is provided with a pair of transverse recesses 4—4 disposed intermediate the edges of the associated plate. In the configuration shown, the elastic band 3, which may be made out of rubber, is captured in the recesses 4. In particular, in a normal or rest position of the plates 1 and 2 shown in FIG. 1, the surfaces 5 and 6 thereof are disposed in overlapping relationship, with the edges 11 and 12 being adjacent and parallel as shown. In this position, the recesses 4 are transversely and vertically aligned, and the elastic band 3 extends around all of the aligned recesses in a plane parallel to the aligned edges 11 and 12. In this position, the band 3 is employed to hold the plates 1 and 2 together.

Figure 2:
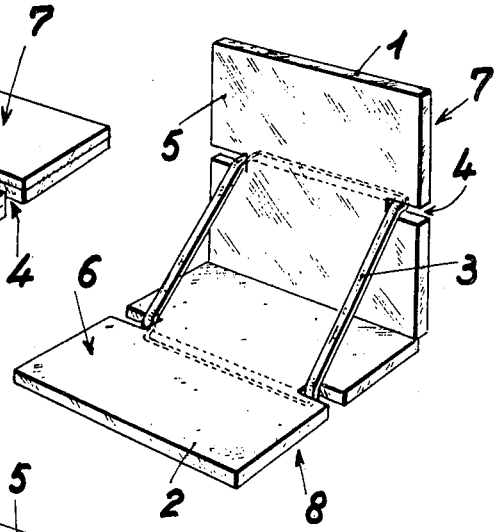
FIG. 2 is a perspective view of the toy of FIG. 1, with one of the constituent plates thereof being relatively rotated 90° with respect to the position shown in FIG. 1.

As shown in FIG. 2, the plates 1 and 2 may be relatively rotated with respect to each other about their respective edges 11 and 12 against the restoring force provided by the band 3. In FIG. 2, the relative rotation has proceeded through 90°, so that the band 3 is stretched out of the transverse plane indicated in FIG. 1.

Figure 3:
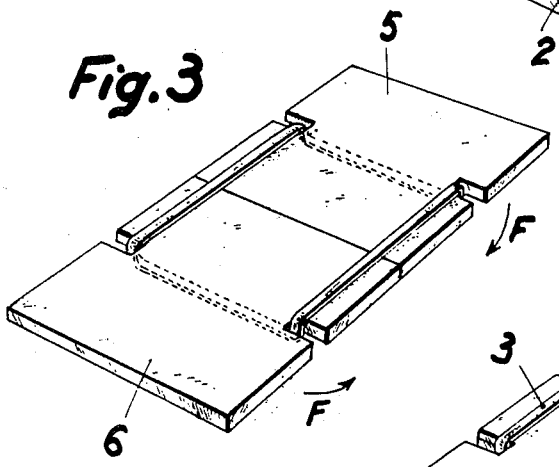
FIG. 3 is a perspective view of the toy of FIG. 1, with one of the constituent elements thereof being rotated to 180° with respect to the position shown in FIG. 1.

Further rotation of the plates 1 and 2 about their edges 11 and 12 yields the 180° position indicated in FIG. 3, wherein the edges 11 and 12 lie transversely side-by-side, and the band 3 effectively extends in the common plane formed by the plates 1 and 2.

Figure 4:
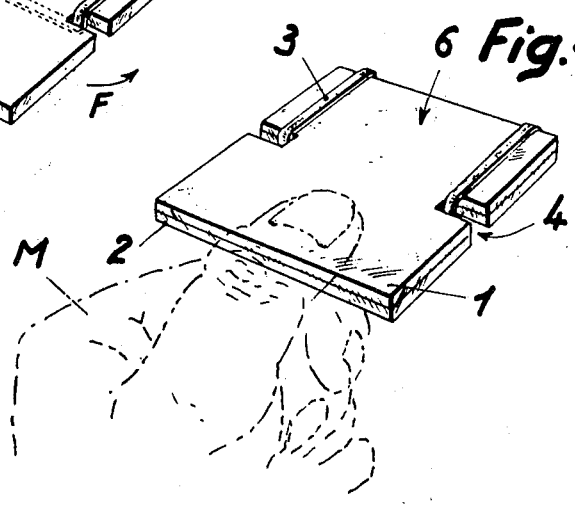
FIG. 4 is a perspective view of the toy of FIG. 1, with one of the constituent elements being rotated approximately 360° to an operated position relative to the position shown in FIG. 1, the elements being fully tensioned and held together prior to release by a player.

Further rotation of the plates in the same direction leads to a 360° orientation as shown in FIG. 4, wherein the opposed surfaces 7 and 8, rather than the initial surfaces 5 and 6, are in overlapping, mutually contacting relation. In this position, the band 3 is stretched to its maximum tension, and a player's hand indicated schematically at 13 is necessary to hold the plates together in their overlapped position, at the edges thereof opposite edges 11 and 12.

In order to effect the desired "snap" of the toy, the player's hand 13 releases the plates 1 and 2 from the position held in FIG. 4, so that the plates snap back to the orientation shown in FIG. 1 almost instantaneously because of the restoring force provided by the band 3. The actual sound made upon the impact of the surfaces 5 and 6 when they again come together during this time is determined by the cross-section and configuration of the surfaces 5 and 6. For example, if one or both of the surfaces 5 or 6 is made concave or convex, rather than planar as shown, a different sound would result than that yielded by the arrangement of FIGS. 1–4.

Additionally, although the plates 1 and 2, under the constraint of the band 3, are maintained in the proper orientation in the plane of oscillation during their relative rotation to the positions shown in FIGS. 1–4, if desired a physical joint may be provided to connect the adjacent edges 11 and 12. Such joint can take the form of a conventional hinge connection, a flexible adhesive strip, and the like.

In the foregoing the invention has been described in connection with one illustrative arrangement thereof. Many variations and modifications will now occur to those skilled in the art. It is accordingly desired that the scope of the appended claims not be limited to the specific disclosure herein contained.

What is claimed is:

1. In a snap-action toy comprising first and second plate elements each having opposed first and second surfaces separated by a first edge extending in a first plane, the plate elements being normally disposed so that their respective first edges are disposed parallel and adjacent each other, and means including resilient means for effecting a rotation of one of the plate elements with respect to the other of the plate elements in a second plane normal to the first plane, the improvement in which the plate elements are normally disposed in superposed relation with substantially their entire respective first surfaces in contact and with their first edges aligned; in which the superposed plate elements exhibit aligned pairs of peripheral recesses disposed in a third plane extending parallel to and spaced from the first plane; and in which the resilient means comprises a closed elastic ring extending around the recesses of the superposed plate elements in the second plane, whereby one of the plate elements is rotatable in one direction through substantially 360° around the other of the plate elements in the second plane against the restoring force of the elastic ring into an operated position in which the plate elements are disposed with substantially their entire second surfaces in mutual contact, and is rotatable in the opposite direction through substantially 360° from the operated position with a snap action.

2. The improvement as defined in claim 1, in which the closed elastic ring is a rubber band.

3. The improvement as defined in claim 1, in which the first and second plate elements are of rectangular cross-section.

4. The improvement as defined in claim 1, in which each of the first and second surfaces of the plate elements are planar.

* * * * *